US009850588B2

(12) United States Patent
Foyet et al.

(10) Patent No.: US 9,850,588 B2
(45) Date of Patent: Dec. 26, 2017

(54) BISMUTH ELECTROPLATING BATHS AND METHODS OF ELECTROPLATING BISMUTH ON A SUBSTRATE

(71) Applicant: Rohm and Haas Electronic Materials LLC, Marlborough, MA (US)

(72) Inventors: Adolphe Foyet, Lucerne (CH); Margit Clauss, Kriens (CH)

(73) Assignee: Rohm and Haas Electronic Materials LLC, Marlborough, MA (US)

( * ) Notice: Subject to any disclaimer, the term of this patent is extended or adjusted under 35 U.S.C. 154(b) by 0 days.

(21) Appl. No.: 15/226,134

(22) Filed: Aug. 2, 2016

(65) Prior Publication Data

US 2017/0067174 A1 Mar. 9, 2017

Related U.S. Application Data

(60) Provisional application No. 62/215,769, filed on Sep. 9, 2015.

(51) Int. Cl.

| | |
|---|---|
| ***C25D 3/00*** | (2006.01) |
| ***C25D 3/54*** | (2006.01) |
| ***C25D 7/10*** | (2006.01) |
| *C25D 17/10* | (2006.01) |

(52) U.S. Cl.

CPC ..... *C25D 3/54* (2013.01); *C25D 7/10* (2013.01); *C25D 17/10* (2013.01)

(58) Field of Classification Search

CPC ..... C25D 3/54
USPC ..... 205/261
See application file for complete search history.

(56) References Cited

U.S. PATENT DOCUMENTS

| | | | | |
|---|---|---|---|---|
| 3,256,160 | A | 6/1966 | McCarthy | |
| 3,663,384 | A | 5/1972 | Lescure | |
| 4,170,469 | A | 10/1979 | Mori | |
| 4,309,064 | A | 1/1982 | Fukuoka et al. | |
| 4,452,866 | A | 6/1984 | Kamiya et al. | |
| 4,470,184 | A | 9/1984 | Fukuoka et al. | |
| 4,551,395 | A | 11/1985 | Lloyd | |
| 4,590,133 | A | 5/1986 | Lloyd | |
| 4,871,429 | A * | 10/1989 | Nobel | C25D 3/32 205/148 |
| 5,110,423 | A * | 5/1992 | Little | C25D 3/60 106/1.05 |
| 5,209,578 | A | 5/1993 | Eastham et al. | |
| 6,309,759 | B1 | 10/2001 | Tomikawa et al. | |

(Continued)

FOREIGN PATENT DOCUMENTS

| | | |
|---|---|---|
| CN | 101538726 | 9/2009 |
| DE | 102007028211 A1 | 12/2008 |

(Continued)

OTHER PUBLICATIONS

Kemula et al., "The Influence of Surface-Active Substances on the Electrodeposition and Electrooxidation of Metals on the Hanging Mercury Drop Electrode," Roczniki Chemii (no month, 1962), vol. 36, pp. 1203-1216. Abstract Only.*

(Continued)

*Primary Examiner* — Edna Wong
(74) *Attorney, Agent, or Firm* — John J. Piskorski

(57) ABSTRACT

Acid bismuth electroplating baths are stable and have high current efficiency over the life of the baths. The bismuth baths are easy to control because of the reduced number of bath components.

10 Claims, 6 Drawing Sheets

(56) References Cited

U.S. PATENT DOCUMENTS

| | | | | |
|---|---|---|---|---|
| 7,368,046 | B2 | 5/2008 | Adam et al. | |
| 8,277,630 | B2 | 10/2012 | Orihashi | |
| 8,491,774 | B2 | 7/2013 | Egli | |
| 9,228,269 | B2 | 1/2016 | Okada et al. | |
| 2004/0118696 | A1 | 6/2004 | Zhang et al. | |
| 2004/0138509 | A1 | 7/2004 | Bhattacharya et al. | |
| 2011/0124535 | A1 * | 5/2011 | Wada | C25D 3/54 508/103 |
| 2015/0122662 | A1 | 5/2015 | Woertink et al. | |
| 2015/0218723 | A1 | 8/2015 | Miura et al. | |

FOREIGN PATENT DOCUMENTS

| | | | | |
|---|---|---|---|---|
| EP | 2664599 | | 11/2013 | |
| JP | 63171893 | A * | 7/1988 | C25D 3/54 |
| JP | 08199386 | A | 8/1996 | |
| JP | 3418773 | B2 | 6/2003 | |
| JP | 2006052421 | | 2/2006 | |
| JP | 2006117980 | | 5/2006 | |

OTHER PUBLICATIONS

Rehamnia, et al, "Study of some surfactants on tins and tin-bismuth electrodeposition from an acid electrolyte Sn(II) sulphate", Asian Journal of Chemistry, vol. 21, No. 3 (2009) pp. 1787-1791.

Search report for corresponding Europe Application No. 16 18 6027 dated Apr. 20, 2017.

Search report for corresponding Taiwan Application No. 105127929 dated Apr. 18, 2017.

* cited by examiner

BISMUTH ELECTROPLATING BATHS AND METHODS OF ELECTROPLATING BISMUTH ON A SUBSTRATE

FIELD OF THE INVENTION

The present invention is directed to bismuth electroplating baths and methods of electroplating bismuth on a substrate. More specifically, the present invention is directed to bismuth electroplating baths and methods of electroplating bismuth on a substrate where the bismuth electroplating baths are stable, easy to control due to minimal bath components, have a high plating speed and have high current efficiency over the life of the bath.

BACKGROUND OF THE INVENTION

Recently there has been an increase in the demand for electrolytic bismuth plating processes for electroplating bismuth metal as opposed to electrolytic alloy plating processes where bismuth and at least one other metal such as tin, copper and lead, for example, is being electroplated to form a binary, tertiary or quaternary metal alloy deposit. Typically such alloys have included bismuth as a secondary or tertiary component with another metal or metals dominating the alloy. While bismuth electroplating baths and processes had been known for some time such as, for example, the bismuth plating bath disclosed in U.S. Pat. No. 3,256,160 for plating bismuth directly on steel, such baths, in general, have been difficult to work with because they were unstable, such as due to incompatible bath additives or premature breakdown of bath components, had low plating speeds and low percent current efficiencies, thus being overall inefficient and costly to the industry. Low percent current efficiencies typically mean that undesired side reactions occur along with the main reaction during electroplating. In addition low percent current efficiencies lead to low plating speeds.

Bismuth metal is highly desirable in many industries because of its anticorrosion and antiseizure properties. Bismuth has good wear and good fatigue resistance. Bismuth also has the unique feature of expanding upon solidification, thus having the desired property of conformability. The properties of bismuth make it highly desirable as a metal for bearings, such as in internal combustion engines both gasoline and diesel. Bearings, such as journal bearings, require good surface properties since they must slide against mating surfaces without causing wear to either the surface and without "seizing", i.e., welding to the mating surface. This property typically requires that the metal or alloy is soft and has a relatively low melting point, or contains a low melting point constituent. The metal or alloy also needs to be capable of carrying the load imposed by the mating surface, which is often cyclic in nature, without break-up or fatigue of the bearing. Sufficient hardness is also an important property, thus a suitable metal or alloy ideally must have a proper balance of all of the foregoing properties.

Since the output of recent internal combustion engines, especially diesel engines, tends to be high, metal overlay layers coating the bearings are subject to peeling off due to fatigue as well as other physical stresses. In addition, corrosive organic acids formed in lubricating oil cause corrosion of the overlay layers. Metals or metal alloys which make up the overlay layer on bearings are typically deposited by electrolytic plating, sintering, sputtering, bonding by rolling and casting processes; however, if such processes deposit a porous layer the reliability of the overlay layer becomes compromised and resistance to fatigue and even rate of corrosion may increase.

Accordingly, there is a need for a bismuth electroplating bath which is stable and electroplates uniform bismuth metal deposits at high plating rates, with high percent current efficiency and may be used in the manufacture of bearings where good fatigue, wear and corrosion resistance are desired.

SUMMARY OF THE INVENTION

The present invention is directed to bismuth electroplating baths including one or more sources of bismuth ions; one or more acids; and one or more polyoxyethylene aryl ethers; the bismuth electroplating bath is free of alloying metals.

The present invention is also directed to a method of electroplating bismuth metal including: providing a substrate; providing a bismuth electroplating bath including one or more sources of bismuth ions; one or more acids; and one or more polyoxyethylene aryl ethers; the bismuth electroplating bath is free of alloying metals; contacting the substrate with the bismuth electroplating bath; applying a current to the bismuth electroplating bath and substrate; and electroplating bismuth on the substrate.

The bismuth electroplating baths of the present invention are stable and have a high percent current efficiency over the life of the bath. The bismuth electroplating baths are easy to control during the electroplating process because they have minimal bath additives in contrast to many conventional bismuth electroplating baths. The reduced bath additives provide for bismuth electroplating baths which are more economical because the quantity of components to be replenished is reduced and the number of parameters to be analyzed during operation is also reduced. The bismuth deposits have matte appearance and have substantially uniform grain structure. The bismuth electroplating baths may be used to electroplate bismuth on substrates where electroplated bismuth is desired. The bismuth electroplating baths may be used in the manufacture of bearings for engines such as gasoline and diesel engines. Typically the bismuth electroplating baths are used to electroplate bismuth metal on overlay layers of bearings.

DETAILED DESCRIPTION OF THE INVENTION

Figure 1:
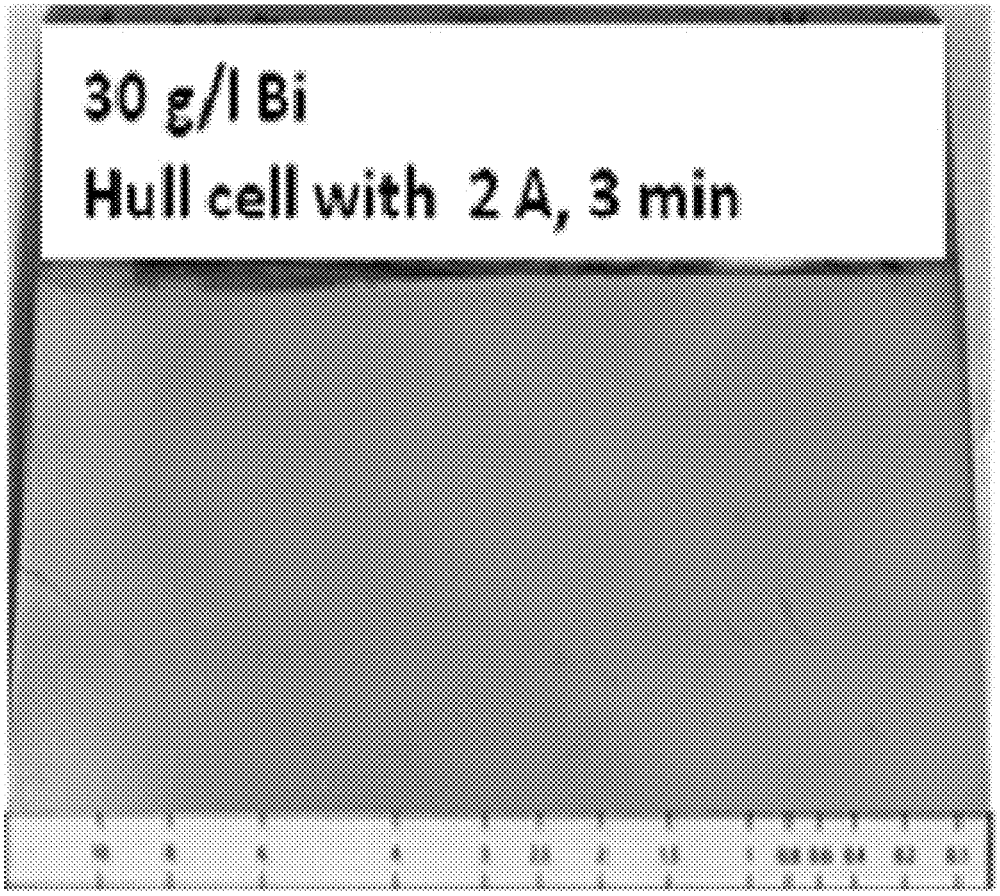
FIG. 1 is a photograph of a matte bismuth metal deposit on a Hull cell plated at 2 A for 3 minutes and shows the bismuth deposit appearance over a current density range of 1-12 ASD.

The following abbreviations have the following meanings unless the context clearly indicates otherwise: ° C.=degrees Celsius; g=grams; mL=milliliter; L=liter; A=amperes; dm=decimeter; ASD=ampere/$dm^2$; μm=microns; cm=centimeters; % CE=percent current efficiency; Ah/L=ampere hours per liter or bath age; h=hours; DI=deionized; DC=direct current; XRF=X-Ray Fluorescence; Ph=phenyl group; and bismuth ions=bismuth (III)=$Bi^{3+}$.

All percentages and ratios are by weight unless otherwise indicated. All ranges are inclusive and combinable in any order except where it is logical that such numerical ranges are constrained to add up to 100%.

As used throughout this specification, the terms "plating" and "electroplating" are used interchangeably. The indefinite articles "a" and "an" are intended to include both the singular and the plural. The term "current efficiency" means a fraction of applied current or electrical charge which is effectively involved in the expected electrochemical reaction.

The present invention is directed to a stable aqueous based bismuth metal electroplating bath which deposits uniform matte bismuth metal. The bismuth metal deposits also have substantially uniform grain size. The bath has a high plating speed and high percent current efficiency. The high percent current efficiency induces high plating speeds and less undesirable side reactions during electroplating. Low current efficiencies typically cause side reactions which result in the decomposition of bath additives by oxidation or reduction, thus the bath may require more replenishment of components to maintain plating. Also at low percent current efficiencies soluble anodes release more metal ions into the bath which may destabilize the bath and make it harder to control. A high percent current efficiency allows for the use of a soluble anode which permits easier control of the plating process than an insoluble anode. Insoluble anodes may cause the breakdown of bath additives, typically at the anode surface, and in the case of bismuth electroplating may oxidize bismuth (III) ions to the undesirable bismuth (V) ions. The additives in the bath are minimal to reduce maintenance and operation cost of electroplating. The bath is free of alloying metals, thus the bath deposits are substantially 100% bismuth metal.

While the bismuth electroplating baths may be plated at current densities from 0.5 ASD and higher, the preferred current density range for achieving a percent current efficiency of 95% to 100% is 0.5 ASD to 10 ASD. A matte deposit may be achieved at current densities of 0.5 ASD to as high as 25 ASD. Preferably the bismuth electroplating baths deposit bismuth metal at current densities of 0.5 ASD to 10 ASD to achieve maximum current efficiency and a matte bismuth deposit. More preferably the current density is 0.5 ASD to 8 ASD. Typically plating temperatures are from room temperature to 60° C., more typically from 30° C. to 50° C.

Percent current efficiency or % CE may be determined for an electroplating bath by the following procedure and equations:

$$\% \text{ CE}=[M_{exp}/M_{th}]\times 100$$

The variable $M_{exp}$ is the experimental mass of the deposit, i.e., the difference between the mass of the substrate before and after plating, and $M_{th}$ is the theoretical mass of the deposit determined from Faraday's Law:

$$M_{th}=(ItM)/zF,$$

where I is the applied current, t is the deposition time, z is the valence of the element plated, M is the molar mass of the element plated and F is the Faraday constant.

The experimental mass therefore is determined by the following equation:

$$M_{exp}=(m_f-m_i),$$

where $m_f$ is mass of the substrate after plating and $m_i$ is the mass of the substrate before plating. % CE can be determined for any single deposit. % CE is expressed in relation to bath age or Ah/L to show that bath performance remains relatively stable during electroplating. While the bath age at which the % CE is determined may be extended until the end of the bath life, the parameter of bath age is determined between 0 Ah/L and 100 Ah/L. In general these two parameters together measure the overall stability of the electroplating bath. The higher the % CE over a relatively long bath age, the greater that stability of the electroplating bath. In other words, if an electroplating bath maintains a continuously high and constant % CE and deposit properties over a long bath age, it can be concluded that such a bath is highly stable.

The relationship between the % CE and the Ah/L provide a measure of how long a bath may operate before replacement by a new makeup. The bismuth electroplating baths of the present invention have a bath composition which is highly stable under bath operation conditions and maintenance. The average % CE ranges from 90% to 100%, preferably from 95% to 100%.

The aqueous acid bismuth electroplating bath includes one or more sources of bismuth ions which provide the electroplating bath with $Bi^{3+}$ ions in solution. Preferably the sources of bismuth ions are water soluble. Sources of bismuth ions include, but are not limited to bismuth salts of alkane sulfonic acids such as bismuth methanesulfonate, bismuth ethanesulfonate, bismuth propanesulfonate, 2-bismuth propane sulfonate and bismuth p-phenolsulfonate, bismuth salts of alkanolsulfonic acids such as bismuth hydroxymethanesulfonate, bismuth 2-hydoxyethane-1-sulfonate and bismuth 2-hydroxybutane-1-sulfonate, and bismuth salts such as bismuth nitrate, bismuth sulfate and bismuth chloride. Bismuth salts are included in the plating baths to provide bismuth ions in amounts of 2 g/L to 60 g/L, preferably from 10 g/L to 40 g/L, more preferably from 25 g/L to 35 g/L for high speed plating and 5 g/L to 15 g/L for barrel plating. Such bismuth salts are commercially available or may be made according to disclosures in the chemical literature. They are generally commercially available from a variety of sources, such as Aldrich Chemical Company, Milwaukee, Wis.

The aqueous based acid bismuth baths also include one or more acids which provide an electrolyte matrix for the bath and an acid pH of less than 1 to 2, preferably less than 1. The acids can be organic or inorganic and mixtures of such acids may be used. Inorganic acids include, but are not limited to, sulfuric acid, nitric acid, hydrochloric acid and sulfamic acid. Preferably the inorganic acid is sulfuric acid. Inorganic acids are included in the baths in amounts of 10 g/L to 200 g/L, preferably from 20 g/L to 100 g/L, more preferably from 30 g/L to 70 g/L.

Organic acids which may make up the electrolyte matrix include, but are not limited to alkane sulfonic acids, alkanol sulfonic acids and aromatic sulfonic acids. Alkane sulfonic acids include but are not limited to methanesulfonic acid, ethanesulfonic acid, propanesulfonic acid, 1-propanesulfonic acid, 2-propanesulfonic acid, 1-butanesulfonic acid, 2-butanesulfonic acid, pentanesulfonic acid, hexane sulfonic acid, decane sulfonic acid and dodecane sulfonic acid. Alkanol sulfonic acids include, but are not limited to 1-hydroxy propane-2-sulfonic acid, 3-hydroxypropane-1-sulfonic acid, 4-hydroxybutane-1-sulfonic acid, 2-hydroxyhexane-1-sulfonic acid, 2-hydroxydecane-1-sulfonic acid, 2-hydroxy-dodecane-1-sulfonic acid, 2-hydroxyethane-1-sulfonic acid, 2-hydroxypropane-1-sulfonic acid, 2-hydroxybutane-1-sulfonic acid and 2-hydroxypentane-1-sulfonic acid. Aromatic sulfonic acids include, but are not limited to benzenesulfonic acid, alkylbenzenesulfonic acid, phenolsulfonic acid, cresol sulfonic acid, sulfosalicylic acid, nitrobenzenesulfonic acid, sulfobenzoic acid, and diphenylamine-4-sulfonic acid. Preferably the organic acids are alkane sulfonic acid. Preferably the organic acids are water soluble. Organic acids are included in the baths in amounts of 10 g/L to 400 g/L, preferably 20 g/L to 180 g/L. Such acids as described above may be obtained commercially or may be made according to disclosures in the chemical literature. They are generally commercially available from a variety of sources, such as Aldrich Chemical Company, Milwaukee, Wis.

The bismuth electroplating baths include one or more polyoxyethylene aryl ethers. Preferably the polyoxyethylene aryl ethers have the following general formula:

(I)

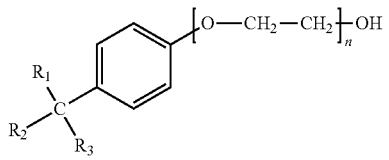

where $R_1$, $R_2$ and $R_3$ are the same or different and are chosen from hydrogen, linear or branched ($C_1$-$C_{20}$)alkyl and phenyl, and n is an integer of 1 to 10. Preferably $R_1$, $R_2$ and $R_3$ are the same or different and are chosen from hydrogen, linear or branched ($C_1$-$C_{10}$) alkyl and phenyl. More preferably $R_1$, $R_2$ and $R_3$ are the same or different and are chosen from linear or branched ($C_1$-$C_5$)alkyl and phenyl. Most preferably $R_1$ is phenyl and $R_2$ and $R_3$ are the same and are chosen from methyl, ethyl and propyl where methyl is preferred. Such compounds are included in amounts of 0.5 g/L to 12 g/L, more preferably the compounds are included in amounts of 1 g/L to 7 g/L. Such compounds are commercially available or may be made according to disclosures in the chemical literature. An example of a commercially available compound of formula (I) above is ADEKA TOL PC-8 available from Adeka Corporation.

Optionally, one or more antifoam agents may be included in the aqueous acid bismuth baths. Conventional antifoam agents may be used and are included in conventional amounts. Antifoams are typically included in amounts of 10 mg/L to 100 mg/L. An example of a preferred commercially available antifoam is FOAM BAN® MS-293 antifoam available from Inwoo Corporation, Gobiz Korea which includes 5-decyne 4,7-diol, 2,4,7,9-tetramethyl (less than 2.5 wt %) and ethylene glycol (less than 2.5 wt %) mixture.

Optionally, one or more amine oxide surfactants may be included in the baths; however, it is preferred that they are excluded from the electroplating bath formulation. Such amine oxide surfactants include, but are not limited to amine oxide tertiary amine compounds having the following formula:

(II)

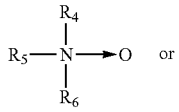

or (III)

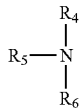

where $R_4$, $R_5$ and $R_6$ are the same or different and are linear or branched, substituted or unsubstituted ($C_1$-$C_{20}$)alkyl groups where the substituents include oxygen, hydroxyl, acid, aldehyde or sulfonic acid groups. Also one or more carbon atoms may be substituted by nitrogen atoms.

Examples of other optional amine oxides are amide propyl dimethylamine oxides having general formula:

(IV)

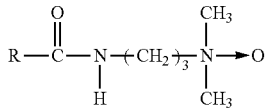

where R is a linear or branched ($C_8$-$C_{16}$)alkyl; or a tertiary amine oxide having formula:

(V)

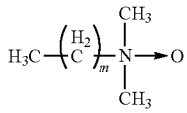

where m is an integer from 8 to 14.

An example of a commercially available amine oxide is AO-455 available from TOMAH Products, Inc. which has the following general structure:

(VI)

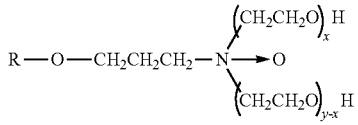

where R is as defined above and x and y are integers such that y-x is not 0.

The amine oxides may be included in the baths in amounts of 0.05 g/L to 15 g/L, preferably from 0.1 g/1 to 5 g/L.

Optionally, the bismuth electroplating bath includes one or more antimicrobials. Conventional antimicrobials typically included in electroplating baths may be used. Such antimicrobials are well known in the art. They are used in conventional amounts.

Preferably the aqueous acid bismuth electroplating bath of the present invention consists of one or more sources of bismuth ions, one or more acids to provide an electrolyte for the bath and an acid matrix, one or more polyoxyethylene aryl ethers, one or more optional additives chosen from antifoam agents, amine oxide surfactants, and antimicrobials, and water. More preferably the aqueous acid bismuth electroplating bath consists of one or more sources of bismuth ions, one or more acids to provide an electrolyte for the bath and an acid matrix, one or more polyoxyethylene aryl ethers having a formula:

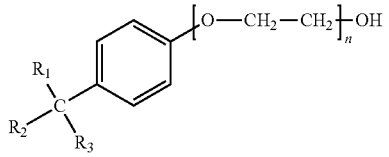

(I)

where $R_1$, $R_2$, $R_3$ and the variable n are as defined above, optionally one or more antifoam agents, and water. Most preferably the aqueous acid bismuth electroplating bath consists of one or more sources of bismuth ions, one or more acids to provide an electrolyte for the bath and an acid matrix, one or more polyoxyethylene aryl ethers having a formula:

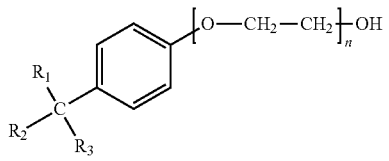

(I)

where $R_1$ is phenyl and $R_2$ and $R_3$ are the same and are chosen from methyl, ethyl and propyl where methyl is preferred, the variable n is as defined above, optionally one or more antifoam agents, and water. The aqueous acid bismuth electroplating baths are free of alloying metals as well as metals which may be typically used to brighten a metal deposit. Preferably the baths are free of complexing and chelating agents and other additives which may be typically included in metal electroplating baths. The aqueous acid bismuth metal electroplating baths of the present invention have minimal bath additives to reduce the probability of undesirable additive interactions and chemical breakdown during electroplating which can result in premature bath breakdown, thus requiring bath replacement, inefficient plating and undesired increase in cost of the electroplating process.

The aqueous acid bismuth electroplating baths of the present invention may be used to electroplate bismuth metal deposits on various substrates where bismuth metal is desired. Such substrates include, but are not limited to metals such as copper, nickel, various copper alloys such as brass, bronze and copper-beryllium alloys. The bismuth electroplating baths are also used to plate bismuth metal layers on bearings such as journal bearings present in gasoline and diesel engines. Because of the properties of bismuth as described above, bismuth is typically included in one or more layers of a bearing. More typically, bismuth is included as a metal in an overlay layer coating the bearing metal alloy matrix. Such overlay layers typically range in thickness of 10 μm to 50 μm. While the journal bearing structure may vary in the specific number and type of metal and metal alloy layers, in general, the bearing is deposited on a base or backing structure which is typically of steel. The bearing matrix material may be deposited on the steel base by various conventional deposition methods for metals and metal alloys known in the art. One method is by sputtering, such as cathodic sputtering, one or more metals adjacent the steel base to form a bearing alloy matrix. The types of metal alloys which comprise the matrix vary greatly. Examples of metal alloys are copper based alloys such as leaded-bronze, aluminum alloys such as aluminum-copper-silicon-tin alloys, various silver containing alloys and lead-tin alloys. Typically the bearing matrix is an aluminum alloy or copper alloy. A bismuth metal layer is then electroplated adjacent the bearing matrix using the bismuth electroplating bath of the present invention. Electroplating is done at current densities of 0.5 ASD to 25 ASD, preferably from 0.5 ASD to 10 ASD, more preferably from 0.5 ASD to 8 ASD. Plating temperatures may range from room temperature to as high as 60° C., preferably from 30° C. to 50° C. Electroplating is done until a desired thickness of bismuth metal is deposited adjacent the matrix. Typically the bismuth is plated to a thickness of at least 0.1 μm, more typically from 1 μm to 30 μm. A metal or metal alloy may then be deposited on the electroplated bismuth layer by electroplating or other conventional method. Such metals include, but are not limited to one or more of lead, tin, cadmium, indium, antimony or alloys of these metals. The metals and metal alloys of the overlay layer including the bismuth metal layer are annealed at temperatures such that diffusion between the metals and metal alloys occur to form the final overlay layer of the bearing. Annealing temperatures may be at least 100° C., typically from 100° C. to 200° C. Optionally, a tin or tin alloy sacrificial layer may be deposited on the overlay layer using conventional methods.

The following examples are included to illustrate the invention but are not intended to limit the scope of the invention.

Example 1

An aqueous bismuth electroplating bath was prepared as shown in the table below.

TABLE 1

| COMPONENT | AMOUNT |
|---|---|
| Bismuth ions ($Bi^{3+}$) from bismuth methane sulfonic acid | 30 g/L |
| Methane sulfonic acid | 162 g/L |
| Polyethylene glycol p-(a,a-dimethylbenzyl)phenyl monoether | 4 g/L |
| 5-decyne 4,7-diol, 2,4,7,9-tetramethyl (less than 2.5 wt %) and ethylene glycol (less than 2.5 wt %) mixture | 20 mg/L |
| pH | <1 |

The polyethylene glycol p-(a,a-dimethylbenzyl)phenyl monoether was the commercially available product ADEKA TOL PC-8 surfactant available from Adeka U.S.A. Corporation, Hackensack, N.J. The surfactant has the following general formula:

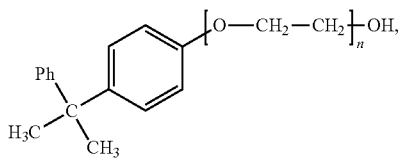

(VI)

where n is an integer from 1-10.

The mixture of 5-decyne 4,7-diol, 2,4,7,9-tetramethyl and ethylene glycol was the commercially available product FOAM BAN® MS-293 antifoam available from Inwoo Corporation, Gobiz Korea. The balance of the electroplating bath was water. The methane sulfonic acid served as an acid electrolyte. The bath components were added to water with stirring at 40° C.

Example 2

The bismuth electroplating bath was placed in a conventional brass Hull cell with a soluble bismuth anode. The current was set at 2 A. DC electroplating was done for 3 minutes at a temperature of 40° C. FIG. 1 is a photograph of the bismuth plated on the brass Hull cell panel. The scale bar at the bottom of FIG. 1 has numbers which correspond to the current density at that particular position along the cell. The numbers on the scale read from left to right are 10, 8, 6, 4, 3, 2.5, 2, 1.5, 1, 0.8, 0.6, 0.4, 0.2 and 0.1 ASD. The plated bismuth had a uniform matte appearance over a current density range of 1-12 ASD.

Example 3

The bismuth electroplating bath of Example 1 was placed in another brass Hull cell with a soluble bismuth anode. Current was at 5 A, the plating time was one minute and the temperature of the plating bath was at 40° C. The appearance of the bismuth deposit was uniform matte in the current density range of 1 ASD to 25 ASD. The plating speed was determined by measuring the thickness of the bismuth deposit at various current densities along the Hull cell. The thickness was measured by XRF using a FISCHERSCOPE® X-Ray model XDV-SD fluorescence analyzer from Helmut Fischer AG. The plating speeds at various current densities along the Hull cell were recorded as shown in Table 2 and were plotted in a graph as shown in FIG. 2.

TABLE 2

| Current Density (ASD) | Plating Time (minutes) | Thickness (microns) - three measurements | Average Plating Speed (microns/minute) |
|---|---|---|---|
| 0.5 | 1 | 0.793; 0.785; 0.774 | 0.78 |
| 1 | 1 | 0.859; 0.878; 0.898 | 0.89 |
| 2 | 1 | 1.16; 1.11; 1.15 | 1.14 |
| 3.8 | 1 | 1.7; 1.56; 1.71 | 1.66 |
| 5 | 1 | 2.14; 2.16; 2.00 | 2.1 |
| 7.5 | 1 | 2.81; 2.37; 2.42 | 2.53 |
| 10 | 1 | 3.12; 2.94; 2.98 | 3.01 |
| 15 | 1 | 4.06; 3.3; 3.46 | 3.61 |
| 20 | 1 | 4.47; 4.01; 4.04 | 4.17 |
| 25 | 1 | 5.31; 4.72; 4.6 | 4.88 |

Figure 2:
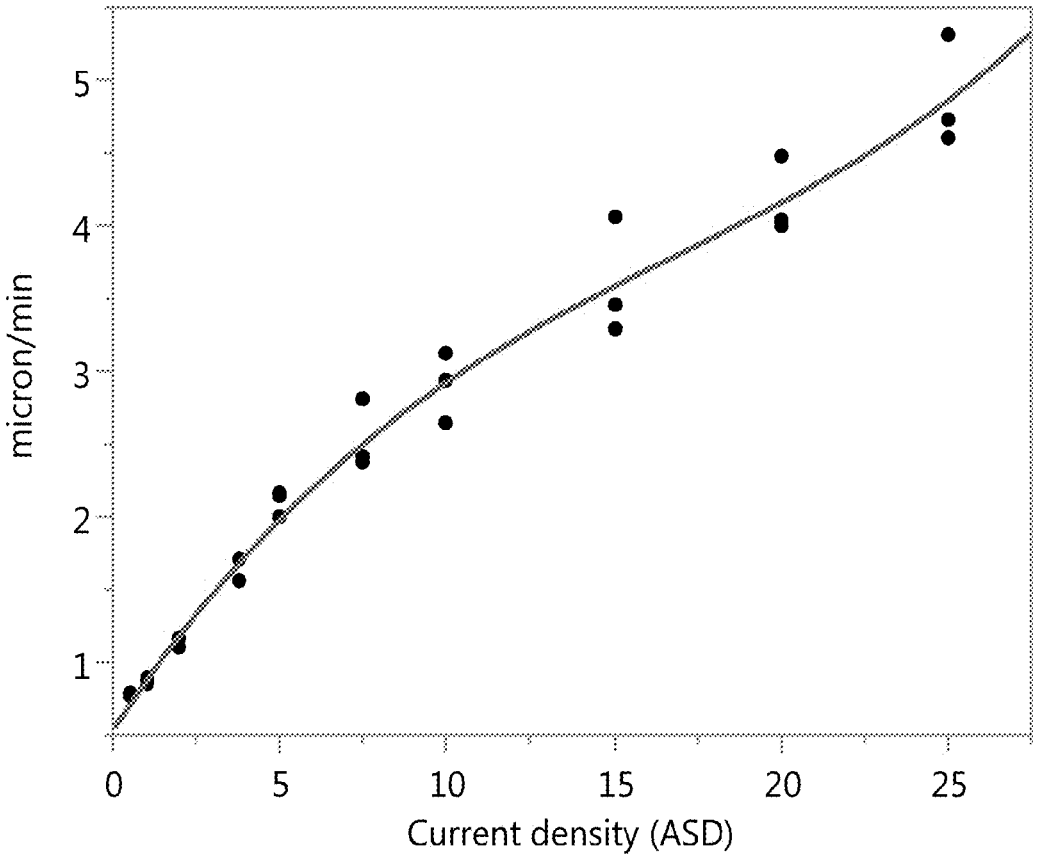
FIG. 2 is a graph of plating speed in microns/minute versus current density in ASD of a bismuth electroplating bath of the present invention.

FIG. 2 shows that the plating speed increased at a near linear rate as the current density increased. At current densities below 10 ASD the graph is linear. Small deviation from the linearity was observed at current densities above 10 ASD. This meant that the current efficiency was decreasing as current densities higher than 10 ASD were applied; however, the current densities were still high. The bismuth deposits over the current density range were all uniform and matte in appearance indicating uniform grain structure.

Example 4

The % CE of the bismuth electroplating bath in Example 1 was determined over electroplating up to a bath life of 100 Ah/L. The % CE was determined using the following equations as described above.

$$\% \text{ CE}=[M_{exp}/M_{th}]\times 100;$$

$$\text{Faraday Law: } M_{th}=(It\,M)/(zF);$$

$$M_{exp}=(m_f-m_i)$$

Mass measurements were done with METTLER TOLEDO Model AB205-S scale with a sensitivity of 1/10000, maximum and minimum load of 220 g and 10 mg, respectively.

The bath age or Ah/L was determined for liter volumes of the bismuth bath as follows:

a) One liter of the bismuth bath was introduced in a cylindrical glass cell;
b) Two soluble bismuth anodes were placed face-to-face in the glass cell and the anodes were connected to a rectifier;
c) A brass panel of about 5 cm to 7.5 cm was fixed on a small clamp and connected to the cathode of the rectifier;
d) A constant DC current of 3 A equivalent to 4 ASD was applied to the system for 20 minutes; and the panel was removed from the cell, rinsed with DI water and dried;
e) Total ampere hours were calculated with the equation: Ah=current (A)×plating time (h); and
f) At each step, the Ah/L was determined by dividing the Ah by the plating bath volume.

Figure 3:
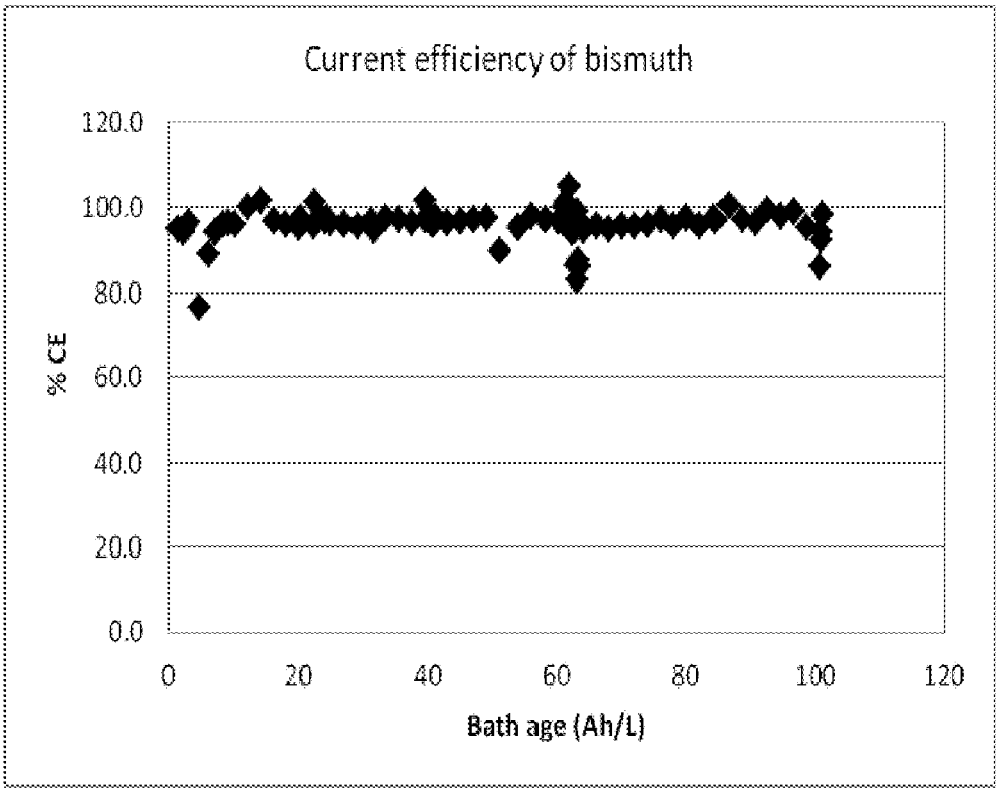
FIG. 3 is a graph of % CE versus bath age in Ah/L of a bismuth electroplating bath of the present invention.

The above test was repeated until a total bath age of 100 Ah/L was reached. The results were plotted in the graph of FIG. 3. About 84 data points were plotted. The results showed a high and stable % CE of close to 100% with an average value of about 95% over a bath age of 100 Ah/L which indicated that the bismuth electroplating bath was stable.

Example 5

Figure 4:
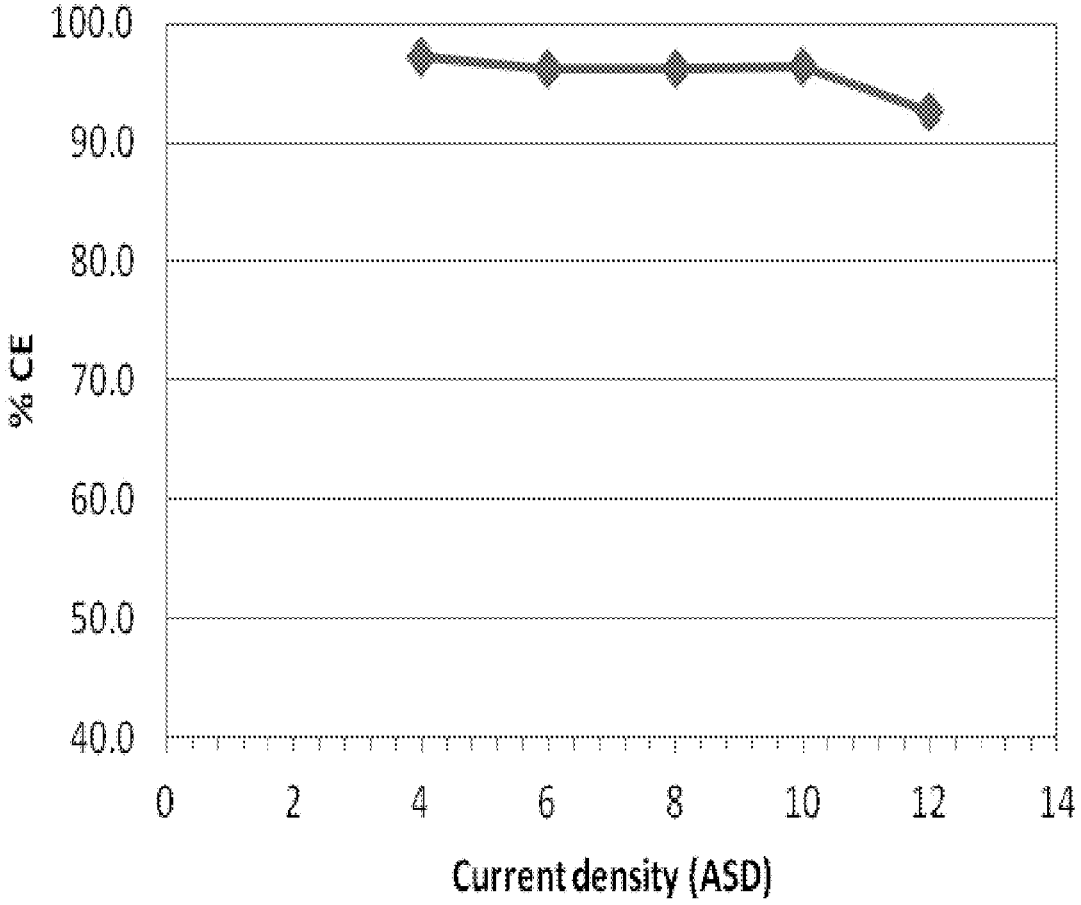
FIG. 4 is a graph of % CE versus current density of bismuth electroplating baths of the present invention.

The above method was repeated at current densities from 4 ASD to 12 ASD. A graph of the average % CE at each current density was plotted as shown in FIG. 4. The % CE was close to 95% over a bath age of 100 Ah/L indicating stable bismuth electroplating baths.

Example 6 (Comparative)

An aqueous bismuth electroplating bath was prepared as shown in the table below.

TABLE 3

| COMPONENT | AMOUNT |
|---|---|
| Bismuth ions ($Bi^{3+}$) from bismuth methane sulfonic acid | 40 g/L |
| Methane sulfonic acid | 53.92 g/L |
| Polyoxypropylene-polyoxyethylene block copolymer | 10 g/L |
| Fatty alcohol ethoxylate | 1 g/L |
| 2-naphthol (12 g/L) dissolved in monopropylene glycol | 5 mL/L |
| pH | <1 |

The polyoxypropylene-polyoxyethylene block copolymer was commercial product POLOXAMER™ 188 solution available from SIGMA-ALDRICH® Company. The fatty alcohol ethoxylate was the commercial product ADUXOL™

LH 023 surfactant available from Schaerer Surfactants. The bath components were added to water with stirring at room temperature.

Example 7 (Comparative)

The bismuth electroplating bath of Table 3 was placed in a conventional brass Hull cell with a soluble bismuth anode. The current was set at 5 A for 1 minute and the cell temperature was kept at 25° C. This temperature corresponded to the optimal temperature for electroplating the formulation of table 3. The thickness of the bismuth deposit at each current density was measured by XRF using a FISCHERSCOPE® X-Ray model XDV-SD, fluorescence analyzer supplied by Helmut Fischer AG. The plating speed at various current densities along the Hull cell were recorded as shown in Table 4 and are plotted in the graph of FIG. 5.

TABLE 4

| Current Density (ASD) | Plating Time (minutes) | Thickness (microns) | Average Plating Speed (microns/minute) |
|---|---|---|---|
| 2 | 1 | 0.54; 0.48 | 0.51 |
| 5 | 1 | 0.92; 0.98 | 0.95 |
| 10 | 1 | 1.45; 1.53 | 1.49 |
| 15 | 1 | 1.95; 1.87 | 1.91 |
| 20 | 1 | 2.17; 2.19 | 2.18 |
| 25 | 1 | 2.82; 2.74 | 2.78 |

Figure 5:
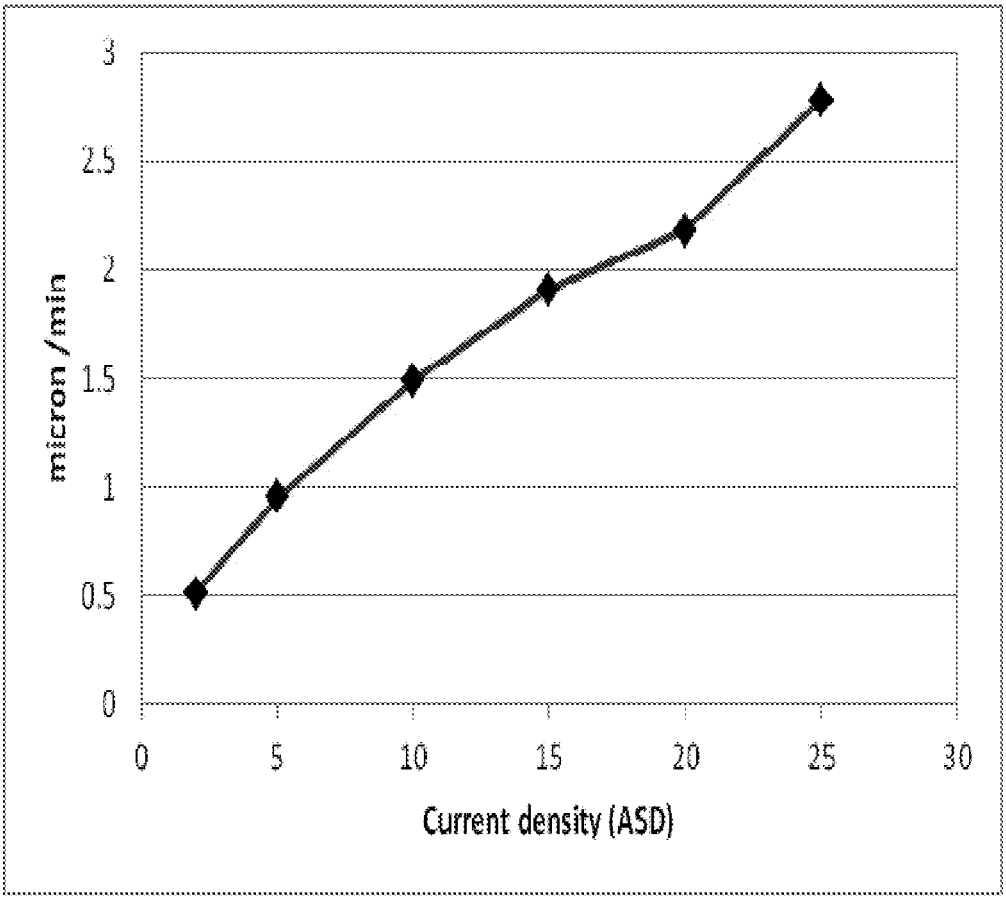
FIG. 5 is a graph of plating speed in microns/minute versus current density in ASD of the bismuth electroplating bath of comparative Example 6.

FIG. 5 shows that the plating speed increased at a near linear rate as the current density increased; however, the plating speed of the bismuth bath of Table 3 was considerably slower than the plating speed of the bismuth bath of Example 1, Table 1. For example, the average plating speed of the bath in Table 3 at 5 ASD was only 0.95 microns/minute while the average plating speed of the bismuth bath of Table 1 was 2.1 microns/minute. At a current density of 10 ASD the plating speed of the bismuth bath in Table 3 was 1.49 microns/minute. In contrast, the plating speed of the bismuth bath of the present invention of Table 1 was 3.01 microns/minute. At a current density of 25 ASD the bismuth bath in Table 3 had an average plating speed of only 2.78 microns/minute while the bismuth bath of the present invention had an average plating speed of 4.88 microns/minute.

Example 8 (Comparative)

The % CE versus the bath age of the bismuth electroplating bath in Example 6 were determined according to the procedure described in Example 4 except that the bismuth plating was done up to a bath age of up to 11 Ah/L. Because of the poor efficiency of the bath formulation of Table 3, the % CE at higher bath ages was not obtained. The bath was unstable at the higher bath ages and the bismuth ion concentration from the soluble bismuth anode increased the bismuth ion concentration to levels such that periodic dilutions were needed to maintain plating operation. The results are in Table 5.

TABLE 5

| % CE | Bath Age (Ah/L) |
|---|---|
| 33 | 1.67 |
| 54.7 | 2.50 |
| 49.8 | 4.17 |
| 55.9 | 5.83 |

TABLE 5-continued

| % CE | Bath Age (Ah/L) |
|---|---|
| 57.9 | 7.50 |
| 60.3 | 9.17 |
| 58.2 | 10.83 |
| 54.2 | 11.00 |

Figure 6:
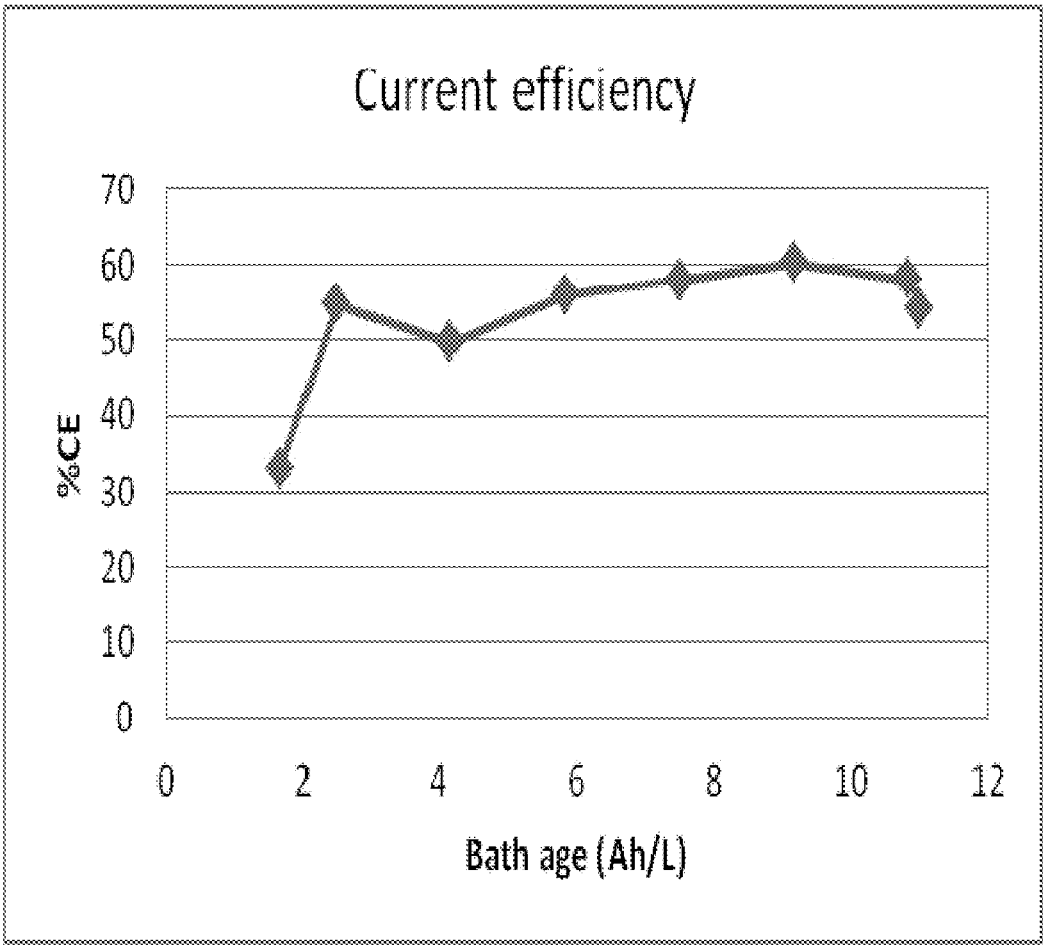
FIG. 6 is a graph of % CE versus bath age in Ah/L of the bismuth electroplating bath of comparative Example 6.

FIG. 6 is a plot of the data from Table 5. The results showed a low % CE ranging from 31% to only a high of 60% with an average % CE of 53%. In contrast, the % CE of the bismuth electroplating bath of the present invention in Table 1 had a low % CE of 79% with a high % CE of 100% and an average % CE of 95%. The % CE of the bismuth bath of the present invention was significantly improved over the % CE of the comparative bismuth bath indicating improved bath performance.

What is claimed is:

1. A bismuth electroplating bath consisting of one or more sources of bismuth ions; one or more acids; and one or more polyoxyethylene aryl ethers; water; and, optionally, one or more amine oxides, one or more antifoam agents, and one or more antimicrobials; the bismuth electroplating bath is free of alloying metals.

2. The bismuth electroplating bath of claim 1, wherein the one or more polyoxyethylene aryl ethers have a formula:

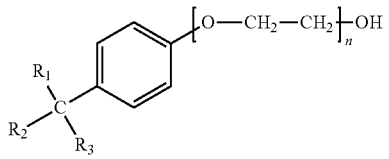

(I)

wherein $R_1$, $R_2$ and $R_3$ are the same or different and are chosen from hydrogen, linear or branched ($C_1$-$C_{20}$) alkyl and phenyl, and n is an integer of 1 to 10.

3. The bismuth electroplating bath of claim 1, wherein the one or more polyoxyethylene aryl ethers are in amounts of 0.5 g/L to 12 g/L.

4. The bismuth electroplating bath of claim 1, wherein the one or more sources of bismuth ions are chosen from bismuth salts of alkane sulfonic acids, bismuth salts of alkanol sulfonic acids, bismuth sulfate, bismuth nitrate and bismuth chloride.

5. The bismuth electroplating bath of claim 1, wherein the one or more acids are chosen from organic acids and inorganic acids.

6. A method of electroplating bismuth metal comprising:

a) providing a substrate;

b) providing a bismuth electroplating bath consisting of one or more sources of bismuth ions; one or more acids; and one or more polyoxyethylene aryl ethers; water; and, optionally, one or more amine oxides, one or more antifoam agents, and one or more antimicrobials; the bismuth electroplating bath is free of alloying metals;

c) contacting the substrate with the bismuth electroplating bath;

d) applying a current to the bismuth electroplating bath and substrate; and e) electroplating matte bismuth on the substrate.

7. The method of claim 6, wherein a current density during electroplating is from 0.5 ASD to 25 ASD.

8. The method of claim 7, wherein the current density during electroplating is from 0.5 ASD to 10 ASD.

9. The method of claim 6, wherein the substrate is a bearing.

10. The method of claim 6, wherein the one or more polyoxyethylene aryl ethers have a formula:

(I)

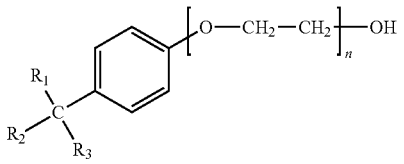

wherein $R_1$, $R_2$ and $R_3$ are the same or different and are chosen from hydrogen, linear or branched ($C_1$-$C_{20}$) alkyl and phenyl, and n is an integer of 1 to 10.

* * * * *